US008430206B2

(12) United States Patent
Griffiths et al.

(10) Patent No.: US 8,430,206 B2
(45) **Date of Patent: *Apr. 30, 2013**

(54) SAFETY DEVICES COMPRISING A LOAD-BEARING COMPOSITE POLYMERIC HOUSING AND A LOAD-BEARING ANCHORAGE PLATE

(75) Inventors: Stephen Griffiths, Gwynedd Wales (GB); Kurt D. Dietrich, Huntersville, NC (US)

(73) Assignee: 3M Innovative Properties Company, St. Paul, MN (US)

( * ) Notice: Subject to any disclaimer, the term of this patent is extended or adjusted under 35 U.S.C. 154(b) by 331 days.

This patent is subject to a terminal disclaimer.

(21) Appl. No.: 12/821,607

(22) Filed: Jun. 23, 2010

(65) Prior Publication Data

US 2011/0315483 A1 Dec. 29, 2011

(51) Int. Cl.
*B66D 5/04* (2006.01)

(52) U.S. Cl.
USPC ..... 182/239; 182/73; 182/234; 182/237

(58) Field of Classification Search ..... 182/73, 182/236–239, 231, 234; 242/381.5, 289
See application file for complete search history.

(56) References Cited

U.S. PATENT DOCUMENTS

| | | | | |
|---|---|---|---|---|
| 3,563,498 | A * | 2/1971 | Haile | 244/122 R |
| 4,437,546 | A * | 3/1984 | Marinoff et al. | 182/233 |
| 4,458,781 | A * | 7/1984 | Ellis et al. | 182/5 |
| 4,511,123 | A * | 4/1985 | Ostrobrod | 254/364 |
| 4,512,438 | A * | 4/1985 | Vilchek et al. | 182/43 |
| 4,653,609 | A * | 3/1987 | Devine | 182/238 |
| 4,877,110 | A | 10/1989 | Wolner | |
| 5,101,935 | A * | 4/1992 | LaBianca | 182/236 |
| 5,184,660 | A * | 2/1993 | Jelic | 160/171 |
| 5,186,289 | A | 2/1993 | Wolner | |
| 5,320,308 | A * | 6/1994 | Bilezikjian et al. | 244/122 R |
| 5,351,906 | A * | 10/1994 | Feathers | 242/396.6 |
| 5,447,280 | A * | 9/1995 | Feathers | 242/381.5 |
| 6,279,682 | B1 * | 8/2001 | Feathers | 182/239 |
| 6,398,141 | B1 * | 6/2002 | Kim | 242/289 |
| 6,648,704 | B1 * | 11/2003 | Fontanille | 440/75 |
| 7,237,650 | B2 | 7/2007 | Casebolt | |
| 7,281,620 | B2 | 10/2007 | Wolner | |
| 8,052,080 | B2 * | 11/2011 | Liang | 242/371 |
| 2009/0084883 | A1 | 4/2009 | Casebolt | |

(Continued)

FOREIGN PATENT DOCUMENTS

| | | |
|---|---|---|
| JP | 10-305109 | 11/1998 |
| JP | 11-269900 | 10/1999 |

(Continued)

OTHER PUBLICATIONS

International Search Report, PCT/US2011/038897, mailed Jan. 11, 2012, 3 pages.

(Continued)

*Primary Examiner* — Alvin Chin Shue
*Assistant Examiner* — Daniel Cahn
(74) *Attorney, Agent, or Firm* — Kenneth B. Wood

(57) ABSTRACT

Herein are disclosed fall-protection safety devices comprising a load-bearing housing comprised of a composite polymeric material, and also comprising a load-bearing anchorage plate connected to the load-bearing housing by at least one load-bearing connector.

18 Claims, 4 Drawing Sheets

U.S. PATENT DOCUMENTS

| | | | | |
|---|---|---|---|---|
| 2009/0178887 | A1* | 7/2009 | Reeves et al. | 182/239 |
| 2009/0211848 | A1 | 8/2009 | Parker | |
| 2011/0303493 | A1* | 12/2011 | Hubbard et al. | 187/254 |

FOREIGN PATENT DOCUMENTS

| | | |
|---|---|---|
| JP | 2002-179342 | 6/2002 |
| JP | 2008-196118 | 8/2008 |
| WO | WO 2007/007119 | 1/2007 |
| WO | WO 2008/008225 | 1/2008 |
| WO | WO 2009/022122 | 2/2009 |

OTHER PUBLICATIONS

Turbolite Product Literature, Miller Turbolite Personal Fall Limiter (Mar. 2008), 4 pages.

Grivory Information Sheet, Grivory Gvx,Metal Replacement at the Highest Level (Nov. 2008), 6 pages.

* cited by examiner

SAFETY DEVICES COMPRISING A LOAD-BEARING COMPOSITE POLYMERIC HOUSING AND A LOAD-BEARING ANCHORAGE PLATE

BACKGROUND

Centrifugally-operated safety devices include such fall-protection devices as e.g. lifelines, self-retracting lifelines, fall arrestors, fall limiters, descenders, and the like. Such devices may comprise a housing that can be connected to a secure anchorage, and from which a line can be extended (e.g., with the outer end of the line attached to the harness of a worker). Such devices may further comprise a centrifugal braking mechanism that can limit or arrest the extending of the line from the device.

SUMMARY

Herein are disclosed fall-protection safety devices comprising a load-bearing housing comprised of a composite polymeric material, and also comprising a load-bearing anchorage plate connected to the load-bearing housing by at least one load-bearing connector.

Thus in one aspect, herein is disclosed a fall-protection device comprising: a load-bearing housing comprised of a composite polymeric material; a rotatable drum mounted on a shaft that is load-bearingly connected to the housing; a centrifugal braking mechanism configured to limit or arrest the rotation of the drum upon rotation of the drum above a predetermined speed; a length of line with a first end attached to at least one of the rotatable drum or the shaft; and, a load-bearing anchorage plate connected to the load-bearing housing by at least one load-bearing connector, wherein the primary load-bearing path from the load-bearing connector of the anchorage plate, to the shaft, is through the load-bearing housing.

These and other aspects of the invention will be apparent from the detailed description below. In no event, however, should the above summaries be construed as limitations on the claimed subject matter, which subject matter is defined solely by the attached claims, as may be amended during prosecution.

Figure 1:
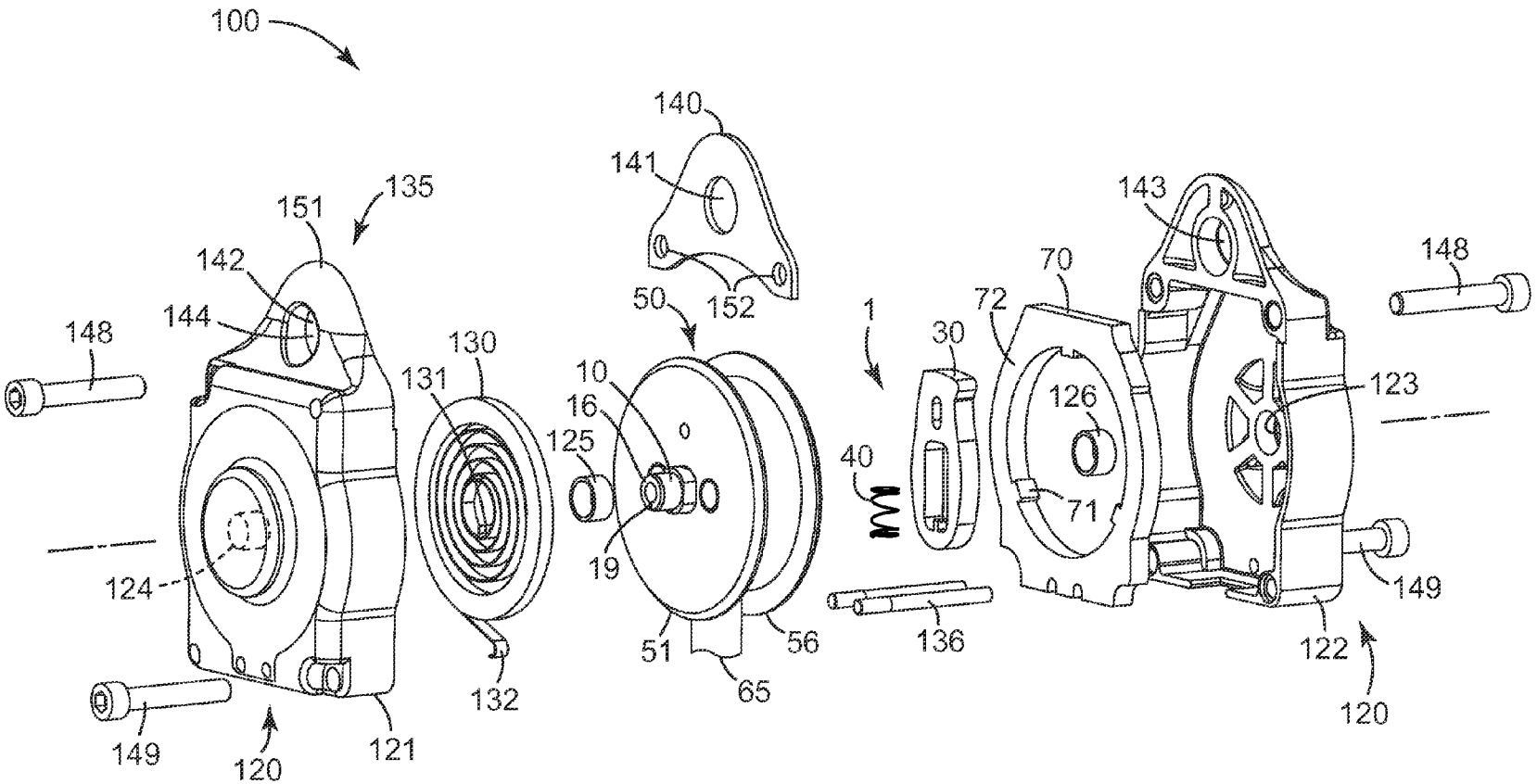
FIG. 1 is an exploded side perspective view of a safety device comprising a load-bearing housing made of a composite polymeric material and comprising an anchorage plate, in a first embodiment.

Like reference numbers in the various figures indicate like elements. Some elements may be present in identical or equivalent multiples; in such cases only one or more representative elements may be designated by a reference number but it will be understood that such reference numbers apply to all such identical elements. Unless otherwise indicated, all figures and drawings in this document are not to scale and are chosen for the purpose of illustrating different embodiments of the invention. In particular the dimensions of the various components are depicted in illustrative terms only, and no relationship between the dimensions of the various components should be inferred from the drawings, unless so indicated. Although terms such as "top", bottom", "upper", lower", "under", "over", "front", "back", "outward", "inward", "up" and "down", and "first" and "second" may be used in this disclosure, it should be understood that those terms are used in their relative sense only unless otherwise noted.

DETAILED DESCRIPTION

Disclosed herein are fall-protection safety devices comprising a load-bearing housing comprised of a composite polymeric material, and a load-bearing anchorage plate that is connected to the load-bearing housing by at least one load-bearing connector. Such devices also comprise a line that can be extended out of a first end of the device (e.g., to be attached to a harness worn by a worker), with the device having a second, anchorage end which may be generally opposite the end from which the line is extendable and which may be connected e.g. by an anchorage line to a secure anchorage of a worksite. Such devices further comprise an apparatus within the housing that can allow the line to be extended from the housing of the device and to be retracted into the housing of the device. Often, such apparatus comprises a shaft bearing a drum, with the line being attached to the shaft or to the drum such that the line can be wound about the drum when the line is retracted into the housing of the device. Such devices further comprise a centrifugally-activated braking mechanism configured to limit or arrest the rotation of the drum upon rotation of the drum above a predetermined speed.

In use, a load may be placed on the safety device, e.g. in the event that the centrifugal braking mechanism is activated to limit or arrest the rotating of the shaft/drum and the extending of the line, so that the device is carrying the load of whatever person or object may be attached to the line. This load may include a static load component (e.g., the weight of a person or object) as well as any dynamic load resulting from deceleration of the person or object.

When such a load is placed on the safety device, the load (i.e., force) is transmitted into the anchorage end of the device (e.g., from an anchorage line that is connected to the anchorage end of the device). At least a portion of the load passes into the load-bearing anchorage plate and is transmitted therefrom into the load-bearing housing, at least partially by way of at least one load-bearing connector. The load-bearing anchorage plate and the load-bearing connector may enhance the transmitting of the load into the load-bearing housing and in particular the distributing of the load over the load-bearing housing, as discussed later herein.

The load is then transmitted from the load-bearing housing into the shaft, by way of a load-bearing connection between the shaft and the housing. The load may then be transmitted therefrom directly into the line (if the line is attached to the shaft) or indirectly into the line by way of the drum (if the line is attached to the drum mounted on the shaft). The load-bearing housing is comprised of a composite polymeric material, e.g. a molded composite polymeric material, as discussed later herein. Such an arrangement stands in contrast to conventional fall-protection safety devices, which typically use a load-bearing housing that is made of metal, or use a metal frame (e.g., comprising one or more metal frame members) to transmit the load from the anchorage line to the shaft. While the latter type of devices may often comprise a polymeric "housing", such a housing is a shell that is used merely for decorative or environmental protection purposes, and is not load-bearing as defined and described herein.

The discoveries disclosed herein allow the use of a load-bearing housing comprised of a composite polymeric material, in a fall-protection safety device, and as such can provide numerous advantages over conventional devices. For example, a housing comprised of composite polymeric materials may offer considerable weight savings over conventional metal housings.

By composite polymeric materials are meant polymeric materials (e.g., moldable/formable polymeric materials such as injection moldable materials, thermoformable materials and the like) that comprise at least one reinforcing filler, as discussed in further detail later herein.

By load-bearing housing is meant that when the safety device is under load, the primary load-bearing path from the anchorage plate and the load-bearing connector, to the shaft, is through the housing. That is, the safety device does not contain any load-bearing members, struts, beams, or the like (that are not an integral part of the housing itself), that provide a significant load-bearing path between the anchorage plate and the shaft. (By significant is meant bearing over 10% of the load when the safety device is placed under load as described herein). In particular embodiments, the safety device does not contain any metal members that provide a significant load-bearing path between the anchorage plate and the shaft.

By housing is meant any structure that at least partially, substantially, or nearly-completely encloses a space containing any or all of e.g. a drum, shaft, line, centrifugal braking mechanism, and/or any other ancillary equipment of the safety device, and that provides the primary load-bearing path from the anchorage plate to the shaft. As such, a housing may nearly completely enclose an interior space containing e.g. the drum, shaft, line, centrifugal braking mechanism, etc. (except for such openings as are needed for the line to be extended out of the housing). Housings of this general type are illustrated e.g. in FIGS. 1 and 2 and are discussed later in detail. Or, a housing may comprise a relatively open frame which might be as minimal as a single load-bearing support member that connects the anchorage end of the device to the shaft and that provides the primary load-bearing path from the anchorage end of the housing to the shaft. All of these possible designs are encompassed by the term load-bearing housing, as long as the conditions disclosed herein are met.

By anchorage plate is meant a load-bearing plate that is not integrally formed with the load-bearing housing and that provides a load-bearing path from the anchorage end of a safety device into the load-bearing housing of the device (which then provides the primary load-bearing path from the anchorage plate to the shaft, as discussed above); an anchorage plate by definition does not provide a direct load-bearing path between the anchorage end of the safety device and the shaft. As used herein the term plate is used broadly and is not meant to be limited to any particular geometric shape or design, as long as the desired functioning is provided.

Further details of the use of a load-bearing housing comprised of a composite polymeric material, in combination with a load-bearing anchorage plate, are discussed with reference to the exemplary self-retracting lifeline safety device 100 shown in partially exploded view in FIG. 1. Load-bearing housing 120 of device 100 may comprise first complementary housing piece 122 and second complementary housing piece 121 that are assembled and fastened together to form housing 120. Complementary housing pieces 121 and 122 may be fastened together by bolts 148 and 149 as shown in FIG. 1, or by any other suitable fastener(s). Such a bolt may be threadably engagable to a threaded receptacle provided in a complementary housing piece. Such a threaded receptacle may comprise e.g. a threaded surface of the housing piece material within the receptacle. Or, such a threaded receptacle may be provided e.g. by inserting a threaded socket in the housing receptacle (e.g., as in the embodiment of FIG. 2, discussed later herein).

Within the interior space defined by housing 120 is drum 50, upon which is wound (e.g., spirally wound) a length of line 65 (with the term line broadly encompassing any elongated windable load-bearing member, including e.g. webbing, cable, rope, etc., made of any suitable synthetic or natural polymeric material, metal, etc., or any combination thereof). Drum 50 may be mounted on shaft 10, and may comprise first and second flanges 51 and 56, each extending generally radially outward from shaft 10, and which are positioned generally parallel to each other to define a space therebetween within which line 65 may be at least partially wound. Flanges 51 and 56 may be made of e.g. molded plastic or any other suitable material. Drum 50 may be comprised of separate flanges that are attached to each other; or drum 50 and flanges thereof may comprise a single (e.g., molded polymeric) unitary piece.

In some embodiments, drum 50 may be mounted to shaft 10 so that drum 50 cannot rotate freely, or at all, relative to shaft 10. Shaft 10 is connected to housing 120 by a load-bearing connection. For example, shaft 10 may have a long axis and a first terminal end 15 (not directly visible in FIG. 1 due to the angle of view) that is rotatably seated into shaft-receiving receptacle 123 of first complementary housing piece 122, and a second terminal end 16 that is rotatably seated into shaft-receiving receptacle 124 of second complementary housing piece 121. In the illustrated embodiment, first and second sleeve bearings 126 and 125 are provided within receptacles 123 and 124. External torsion spring 130 may be provided (external to drum 50), with the inner end of spring 130 comprising tab 131 that fits into slot 19 of shaft 10. The outer end of spring 130 may comprise a hooked end 132 that is attached to one of guide pins 136 (pins 136 may thus serve the dual function of providing an attachment point for spring 130 and of guiding line 65 between pins 136 at the location at which line 65 extends out of housing 120).

Within the space defined by housing 120 is a centrifugal braking mechanism. Such mechanisms in general rely on one or more centrifugally-actuated pawls that, upon rotation of a shaft and/or drum above a predetermined speed, are motivated to a position in which they engage with a ratchet ring that serves to limit or arrest the rotation of the drum. In the illustrated embodiment of FIG. 1, ratchet ring 70 is fixedly attached to housing piece 122 of housing 120, and comprises at least one ratchet tooth 71 which an engaging end of pawl 30 can engage. Pawl 30 is mounted on shaft 10 and is biased by a biasing mechanism, as discussed in more detail later herein.

In use, anchorage end 135 of self-retracting lifeline 100 may be connected or attached to a secure anchorage (fixed point) of a worksite structure (e.g., a girder, beam or the like). The outermost end of line 65 may then be attached (e.g., by way of a carabiner, D-ring, or the like) to a harness worn by a worker. As the worker moves away from the fixed anchorage, line 65 is extended from within housing 120; as the worker moves toward the fixed anchorage, drum 50 rotates under the urging of torsion spring 130, so that line 65 is self-retracted within housing 120 and wound upon drum 50. During such worker activities, pawl 30 is biased by the aforementioned biasing mechanism so that an engaging end of pawl 30 does not engage ratchet ring 70. In the event of a worker fall, the speed of rotation of shaft 10 and pawl 30 increases above a predetermined speed, whereupon an engaging end of pawl 30 is caused to engage with ratchet ring 70 as explained earlier herein, whereupon the speed of falling of the worker is slowed or arrested. This process may result in the aforementioned load being placed upon device 100.

In such uses, a fall-protection safety device might be designed to bring a worker to a full stop (e.g., as in products commonly known as self-retracting lifelines), or merely to control or limit the rate of fall (e.g., as in products commonly known as a descender). In some cases the distinction between these general types of products may not be absolute, with some products serving to at least partially provide one or both functions. It will be understood that the herein-described load-bearing housing comprised of a composite polymeric material, and load-bearing anchorage plate, may be usefully employed in any such safety device. In some embodiments, a safety device as disclosed herein meets the requirements of ANSI Z359.1 2007 (as specified in 2007).

The connecting or attaching of anchorage end 135 of self-retracting lifeline 100 to a secure anchorage may use anchorage opening 144 (resulting from aligned openings 141, 143 and 142 in load-bearing anchorage plate 140, first complementary housing piece 122, and second complementary housing piece 121, respectively) for this purpose. Such attachment may be provided e.g. by passing an anchorage line, rope, cable, etc. (the other end of which is attached to a secure anchorage) through anchorage opening 144 and attaching the anchorage line securely to anchorage beam 151 of housing 120 of device 100. If desired, multiple anchorage openings 144 may be provided. If desired, multiple anchorage lines may be used and may be attached to the same secure anchorage or to different secure anchorages. Devices such as D-rings, shackles, etc. may be used to attach an end of the anchorage line to anchorage opening 144 of device 100. Devices such as swivel joints and the like may also be employed if desired. In some cases, it may be desired to directly (e.g., rigidly) attach housing 120 to a secure anchorage by way of a rigid fastening (anchorage) member passed through anchorage opening 144 (e.g., rather than using a flexible anchorage line or cable that extends from housing 120 to the secure anchorage).

Regardless of the particular method of connecting housing 120 to a secure anchorage, in the above methods of use of device 100 the outer end of line 65 is attached e.g. to a harness worn by a worker and line 65 is extended out of housing 120 and retracted thereinto as explained above. In alternate methods of use of device 100, the outer end of line 65 may be attached to a secure anchorage with housing 120 of self-retracting lifeline 100 being attached to a harness worn by a worker (e.g., by way of anchorage opening 144). The load-bearing housing comprised of a composite polymeric material, and the load-bearing anchorage plate, may function in substantially the same manner, however.

Other ancillary equipment may be employed with self-retracting lifeline 100 as desired. For example, a so-called shock absorber may be employed, e.g. somewhere within the length of line 65, or somewhere with the length of an anchorage line used to secure housing 120 to a secure anchorage. Such a shock absorber (often called a tear web) may comprise e.g. a length of line that is folded in an accordionized configuration and is lightly sewn together and/or encased in a suitable casing, such that in the event of a predetermined load being applied, the line unfolds.

As disclosed herein, the load-bearing housing (e.g., housing 120 comprised of complementary mating pieces 122 and 121) is comprised of a composite polymeric material, e.g. a molded composite polymeric material. By this is meant that at least the primary load-bearing path of the housing (i.e., a portion or portions of the housing that individually or collectively bear at least about 90% of the load when the safety device is placed under load), from the load-bearing connector of the anchorage plate to the shaft, is made of composite polymeric material. In further embodiments, at least 50%, at least about 75%, or at least about 90% by weight of the total housing weight, is provided by composite polymeric material. In a still further embodiments, substantially all of the weight of the housing consists of composite polymeric material. In the above, the weight of e.g. metal components that may be in contact with the housing and/or attached to the housing, but do not serve as part of the housing e.g. in terms of the above-described structure and function of the housing, are not included. As such, a load-bearing housing being comprised of, or consisting of, a composite polymeric material, does not preclude metal components being used with the housing and/or fastened thereto. For example, in the exemplary illustration of FIG. 1, bolts 148 and 149 that are used to fasten housing pieces 122 and 121 together and which may be made of metal, are not counted as being part of load-bearing housing 120. Likewise, threaded sockets that are made of metal and that may be inserted in the receptacles into which threaded shanks of bolts are threadably engaged to fasten housing pieces together, are not counted. In addition, a load-bearing housing being comprised of, or consisting of, a composite polymeric material, does not preclude the presence of metal within the polymeric material itself. For example, the polymeric material may comprise reinforcing filler that comprises metal fibers, whiskers, filaments or the like. Other suitable reinforcing fillers include e.g. inorganic fillers such as glass fibers and the like, carbon fibers, and so on. Those of ordinary skill in the art will appreciate that any reinforcing filler (e.g., of any suitable composition and/or physical shape or form) may be used, e.g. if it significantly increases the impact strength of the polymeric material over that exhibited in the absence of the reinforcing filler.

Suitable composite polymeric materials may comprise, in various embodiments, a density of less than 2.5, 2.0, or 1.8 grams per cubic centimeter, and/or may be comprised of a polyphthalamide-containing polyamide. Suitable moldable composite polymeric materials may include e.g. those materials available from EMS-CHEMIE AG North America, Sumter, S.C., under the trade designation GRIVORY (including in particular the products available under the trade designations GV and GVX).

As mentioned, device 100 comprises load-bearing anchorage plate 140 that is positioned proximate anchorage end 135 of device 100. In the embodiment of FIG. 1, anchorage plate 140 is sandwiched between first and second complementary housing pieces 122 and 121. Anchorage plate 140 is connected to housing 120 by way of at least one load-bearing connector. In the exemplary embodiment of FIG. 1, two load-bearings connectors are used, specifically, bolts 148 (it will be appreciated that any suitable load-bearing fastener or fastening mechanism, whether mechanical, adhesive, etc., may be used). The shanks of bolts 148 pass through through-openings 152 of anchorage plate 140, and are each threaded into a threaded receptacle (e.g., a threaded metal socket insert) of piece 122 or 121. The head of each bolt 148 is seated against a bolt head receiving feature of piece 122 or 121. The tightening of bolts 148 serves to draw pieces 122 and 121 together with anchorage plate sandwiched therebetween. Bolts 148 may be similar or identical to other bolts (indicated generically by the reference number 149) that are used to fasten housing pieces 122 and 121 together; the reference number 148 is merely used to indicate one or more particular bolts that have the additional function of connecting anchorage plate 140 to housing 120.

It is not necessary that the portion of a bolt 148 that resides within an opening 152 of anchorage plate 140 be threadably engaged thereto, although this can be done if desired. That is, the load-bearing connector does not necessarily have to be directly fastened (e.g., threadably engaged) to anchorage plate 140. All that is required is that the load-bearing connector be connected to (e.g., at least be in contact with) anchorage plate 140, in such manner that a load can be transmitted between anchorage plate 140 and the load-bearing connector; and, that the load-bearing connector also be connected to housing 120 (e.g., with pieces 122 and 121 of housing 120), in such manner that a load can be transmitted between the load-bearing connector and housing 120. In the exemplary embodiment of FIG. 1, bolts 148 serve as such connectors and also serve to fasten housing pieces 122 and 121 together. However, in certain embodiments the load-bearing connector(s) might serve only to load-bearingly connect anchorage plate 140 to housing 120 while not serving as a fastener to fasten pieces of housing 120 together (in such case, one or more separate fasteners may be provided for that purpose).

For purposes of convenient illustration, the vertical axis of device 100 and housing 120 thereof is defined as the axis running from anchorage end 135 of housing 120 (e.g., from anchorage plate opening 141 of anchorage plate 140) through shaft 10. The lateral axis of device 100 and housing 120 thereof is defined as being generally perpendicular to the vertical axis and being parallel to the plane of rotation of drum 50. Anchorage plate 140 may extend at least along the lateral axis of device 100 to points proximal to each lateral edge of housing 120 of device 100, as shown in FIG. 1. In the embodiment of FIG. 1, first and second through-openings 152 are provided in anchorage plate 140 at positions proximate the lateral edges of anchorage plate 140.

Anchorage plate 140 may extend along the vertical axis of device 100, but does not extend to, or contact, shaft 10. Thus, anchorage plate 140 provides a load-bearing path from anchorage end 135 of device 100 only into housing 120 and not directly to shaft 10. Furthermore, anchorage plate 140 does not load-bearingly connect with any other load-bearing component (other than housing 120) that then connects with shaft 10.

Anchorage plate 140 can be made of any suitable material, as long as the above-described load-bearing properties are provided. In some embodiments load-bearing anchorage plate 140 is made of metal (e.g., steel).

Anchorage plate 140 may comprise at least one anchorage plate opening 141, which can align and combine with openings 142 and 143 in housing pieces 121 and 122 to provide at least one anchorage opening 144. An anchorage line can be passed through anchorage opening 144 and tied to anchorage beam 151 (which, since it includes the portion of anchorage plate 140 above anchorage plate opening 141, may be load-bearing). In the illustrated embodiment of FIG. 1, anchorage plate 140 is sandwiched between housing pieces 122 and 121 so that the major surfaces of anchorage plate 140 are substantially covered by pieces 121 and 122. (In the illustrated embodiment, housing pieces 121 and 122 are recessed to provide a cavity for anchorage plate 140 so that the edges of housing pieces 122 and 121 mate to obscure the outer minor surfaces of anchorage plate 140, so that the only surface of anchorage plate 140 that may be visible is the minor annular surface defining anchorage plate opening 141). In alternative embodiments, a portion of anchorage plate 140 may protrude outwardly (e.g., along the vertical axis and/or lateral axis of device 100) beyond housing 120, e.g. so that an anchorage line or anchorage member can be secured thereto.

When device 100 is placed under load, at least a portion of the load is transmitted from the anchorage line (or anchorage member) into anchorage plate 140. The load-bearing connecting of anchorage plate 140 (via at least one load-bearing connector, e.g. bolt 148) to load-bearing housing 120, provides that the load is transmitted from anchorage plate 140 into housing 120. In the embodiment of FIG. 1, the providing of two separate load-bearing connections (by way of the two anchorage plate openings 152 each with a shank of bolt 148 passed therethrough and fastened to housing 120 on both sides thereof) at locations proximal to the lateral edges of housing 120, may enhance the distributing of the load into housing 120. As discussed previously, the load is then transmitted through load-bearing housing 120 into shaft 10, e.g. via terminal ends 15 and 16 of shaft 10 being seated into receptacles in housing 120.

Those of skill in the art will appreciate that in the above discussions the load has been described as being transmitted from the anchorage line, into the anchorage end of device 100 and anchorage plate 140 thereof, and from there into load-bearing housing 120 and into shaft 10 therefrom, and eventually into line 65. This viewpoint was assumed only for convenience of description; the load could equivalently be described as passing from line 65 into device 100 and eventually on to the anchorage line, without changing the functioning of device 100 or any of the components thereof.

Further details of the use of a load-bearing housing comprised of a composite polymeric material, in combination with an anchorage plate, are discussed with reference to the exemplary self-retracting lifeline safety device 200 shown in partially exploded view in the embodiment of FIG. 2. Those of skill in the art will appreciate that the general principles of use of device 200 and many components thereof will parallel those described above for device 100, with the previous discussions of such principles and components applying thereto. Housing 220 of device 200 may comprise first complementary housing piece 222 and second complementary housing piece 221 that are assembled and fastened together to form housing 220. In the illustrated embodiment of FIG. 2, they are fastened together by way of threaded bolts 246 and 247 the heads of which are seated against bolt-seating features of one of the housing pieces, with the threaded shanks of the bolts being threadably engaged to threaded socket inserts 255 provided in the other housing piece.

Housing 220 comprises anchorage plate 240 that is sandwiched between first and second complementary housing pieces 222 and 221, at the anchorage end 235 of device 200. Anchorage plate 240 is load-bearingly connected to housing 220, e.g. by way of through-opening 249 in anchorage plate 240 through which a shank of bolt 246 passes as it attaches pieces 222 and 221 together (e.g., a shank of bolt 246 may pass through opening 249 of anchorage plate 240 with a threaded terminal portion thereof being threadably engaged into receptacle 245 of housing piece 222). Bolt 246 may be identical to other bolts (indicated generically by the reference number 247) that are used to attach housing pieces 222 and 221 together; the reference number 246 is merely used to indicate a particular bolt that has the additional function of attaching anchorage plate 240 to housing 220. In device 200 of FIG. 2 (as in device 100 of FIG. 1), any suitable connector(s), fastener(s), connector(s)/fastener(s), and/or combinations thereof, may be used in the load-bearing connecting of anchorage plate 240 to housing 220, the attaching of housing pieces 222 and 221 together, and so on.

Although differing in certain features from anchorage plate 140, anchorage plate 240 performs the same basic function; e.g., anchorage plate 240 comprises anchorage plate opening 241 which combines with housing piece openings 243 and 242 to provide anchorage opening 244 which (e.g., in combination with anchorage beam 248) facilitates the use of an anchorage line or anchorage member to attach or connect device 200 to a secure anchorage. Anchorage plate 240 may extend at least along the lateral axis of device 200 to a point proximal each lateral edge of housing 220 of device 200, and may extend along the vertical axis of device 200, but does not extend to, or contact, shaft 310. Thus, anchorage plate 240 provides a load-bearing path from anchorage end 235 of device 200 only into housing 220 and not directly to shaft 310. Furthermore, anchorage plate 240 does not load-bearingly connect with any other load-bearing component (other than housing 220) that then connects with shaft 310.

Exemplary anchorage plate 240 differs from exemplary anchorage plate 140 in comprising only a single through-opening 249 via which a single load-bearing connector (e.g., bolt 246) can be used to load-bearingly connect anchorage plate 240 to housing 220. Single through-opening 249 is located generally in the lateral center of anchorage plate 240. It will thus be appreciated that in various embodiments an anchorage plate can have one, two, three, or more through-openings via which the anchorage plate can be load-bearingly connected to a housing, which openings can be located in any suitable position on the anchorage plate.

In some embodiments, housing 220 may have features configured to support housing 220 at or near a location at which a load is transmitted between a load-bearing connector (e.g., bolt 246) and housing 220. For example, receptacle 245 of housing piece 222, which is configured to accept and be threadably engaged by threaded shank of bolt 246 (specifically, to contain threaded metal socket insert 255 to which threaded shank of bolt 246 engages) may be a bore (e.g., a molded bore) 245 within a projection (e.g., a molded projection) 256 that protrudes inward from housing 220. Projection 256 thus may comprise such a support feature of housing 220. As used herein, protruding inward means that projection 256 protrudes generally into the interior volume at least partially defined by housing 220 when housing piece 222 is assembled into housing 220. In some embodiments, projection 256 protrudes inward in a direction generally perpendicular to the vertical and lateral axes of device 200. In some embodiments, projection 256 comprises an inwardly-protruding annulus that substantially or completely encircles bore 245. Embodiments of this type are shown in FIG. 2, as well as in the elevation view of housing piece 222, in FIG. 3.

Figure 2:
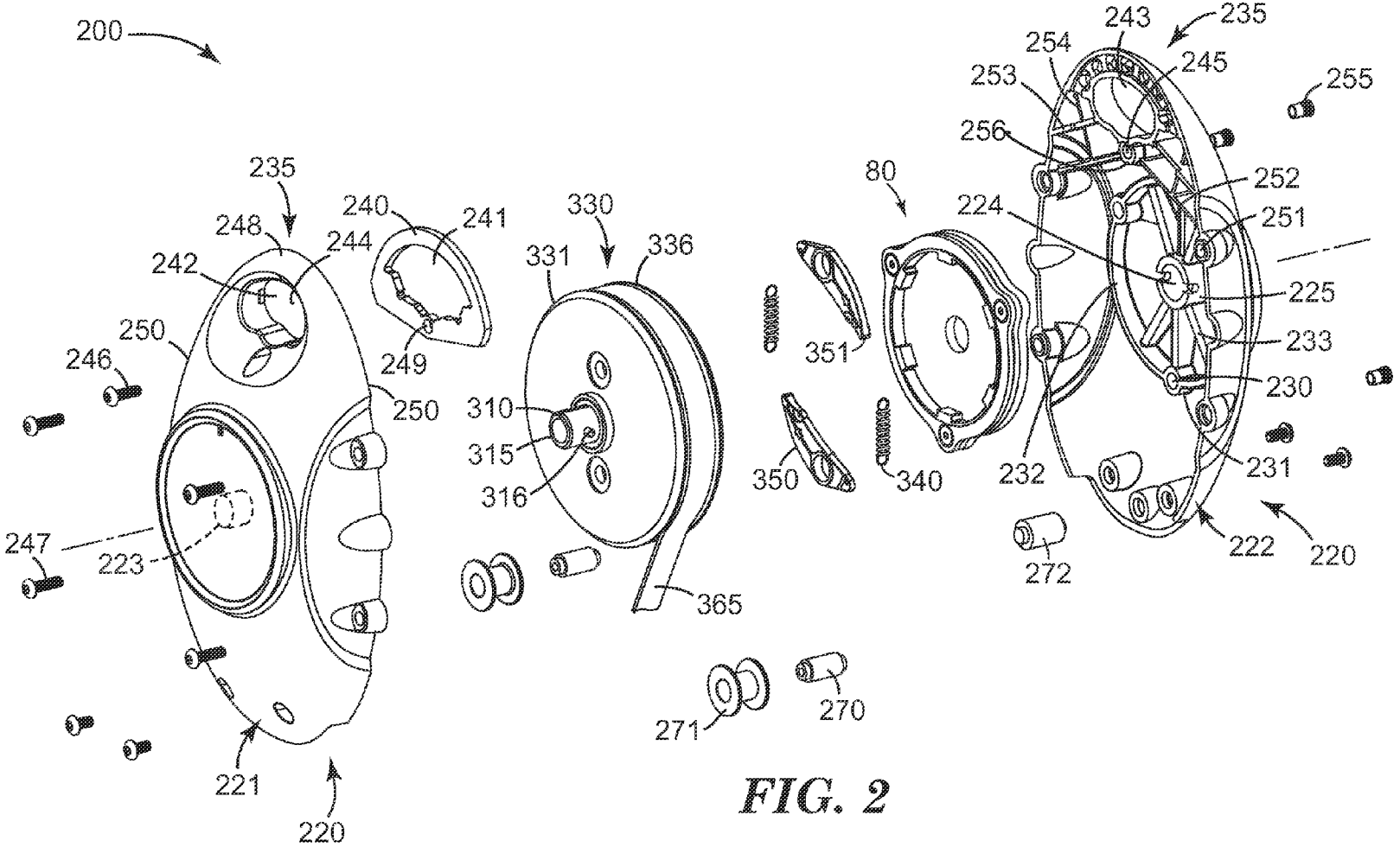
FIG. 2 is an exploded side perspective view of a safety device comprising a load-bearing housing made of a composite polymeric material and comprising an anchorage plate, in a second embodiment.

Although not shown in FIG. 2, similar support features may be present in housing piece 221. For example, the aperture of housing piece 221 that accommodates the portion of the shank of bolt 246 that is proximal to the head of bolt 246, may be a bore within a projection that protrudes inward from housing 220. Similarly, although not specifically discussed previously in regard to the embodiment of FIG. 1, the point of connection or attachment of load-bearing connectors (e.g., bolts 148) to housing 120 may comprise similar support features.

In some embodiments, housing 220 may comprise at least one strut. By strut is meant an elongated member that is connected to and integrally molded with housing 220 (e.g., with housing piece 222) and that protrudes inward into the interior space at least partially defined by housing 220. In some embodiments, a strut protrudes inward in a direction generally perpendicular to the plane of ratchet ring 70, as in FIG. 2.

Figure 3:
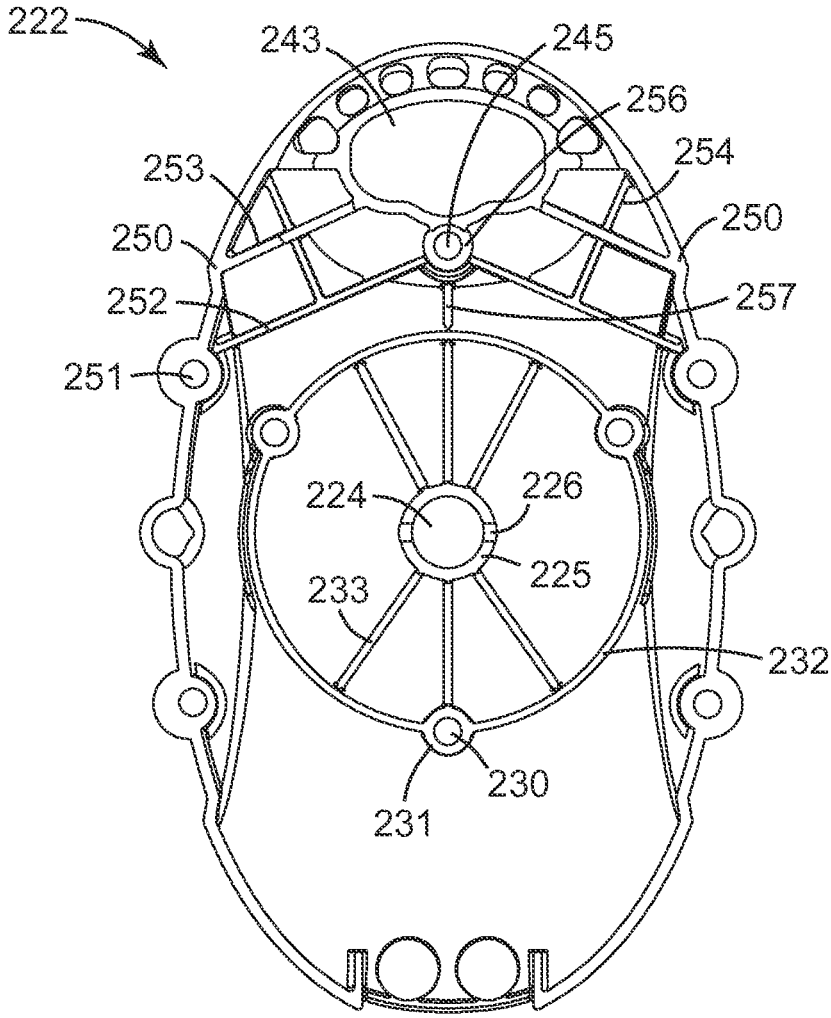
FIG. 3 is an elevation view of a housing piece of the load-bearing housing of the safety device of FIG. 2.

For example, housing 220 may comprise one or more primary struts, that connect with, are integrally molded with, and that extend from, an above-described support feature at a location at which a load-bearing connector may transmit a load to housing 220. For example, as shown in FIGS. 2 and 3, primary struts 252 are integrally molded with, and extend from, projection 256, generally to lateral edges 250 of housing piece 222, with which they connect and are integrally molded with. In some embodiments primary struts 252 connect with and are integrally molded with a support feature (e.g., an inwardly-protruding molded projection comprising a bore 251) at a location on a lateral edge 250 of housing 220 at which a fastener is used to fasten housing pieces 222 and 221 together, as in the embodiment of FIGS. 2 and 3. A primary strut may extend in a direction that is between the lateral axis and the vertical axis of device 200. For example, in FIG. 2, primary strut 252 extends along a line oriented at an angle from the lateral axis of device 200 about twenty degrees downward toward the vertical axis of device 200. In some embodiments a primary strut 252 can be linear along the entirety of its length; in others, it may be arcuate along at least a portion of its length. In some embodiments, primary struts that extend to generally opposite lateral edges 250 of housing 220 can be symmetrical (as in FIGS. 2 and 3); in other embodiments, they can differ e.g. in their angle, curvature, etc.

In some embodiments, housing 220 may comprise one or more secondary struts, that do not connect with a support feature at a location at which a load-bearing connector may transmit a load to housing 220, but rather extend from any location generally proximate an edge of an anchorage opening of a housing piece (e.g., opening 243 of housing piece 222, or opening 242 of housing piece 221). A secondary strut extends to and connects with and is integrally molded with a lateral edge of housing 220 (e.g., of a housing piece), but is not necessarily integrally molded with a support feature (e.g., an inwardly-protruding projection comprising a bore) at a location on a lateral edge 250 of housing 220 at which a fastener is used to fasten housing pieces 222 and 221 together. Exemplary secondary struts 253 are illustrated in FIGS. 2 and 3. As illustrated in FIGS. 2 and 3, a secondary strut may extend generally parallel to a primary strut.

In some embodiments, housing 220 may comprise one or more tertiary struts, that extend between a primary strut and a secondary strut and that are connected thereto and integrally molded therewith. Such an exemplary tertiary strut 254 is shown in FIGS. 2 and 3. In some embodiments, tertiary strut 254 may also extend to and connect to and be integrally molded with, housing 220 at a lateral edge 250 of housing 220; tertiary strut 254 may also extend generally at right angles to a primary and secondary strut(s), both as shown in FIGS. 2 and 3.

Primary, secondary, and tertiary struts, if used, may form a truss that enhances the transmission and distributing of a load from an anchorage plate into and through a load-bearing housing. However, depending on the particular design and parameters of a device, such features may be optional and not required in all cases. For example, housing 120 of device 100 may or may not contain any or all of these features.

With the interior space defined by housing 220 is drum 330, upon which is wound a length of line 365. Pawls 350 are mounted on drum 330 and biased by biasing springs 340. Biased pawls 350 in combination with friction brake 80 (described in more detail later herein) provide a centrifugal braking mechanism. Drum 330 may comprise first and second flanges 331 and 336, each extending generally radially outward from shaft 310, and which are positioned generally parallel to each other to define a space therebetween within which line 365 may be at least partially wound. Drum 330 may comprise an interior torsion spring (not visible in FIG. 2) to facilitate the retracting of line 365 into housing 220 and the winding of line 365 onto drum 330 (or, an exterior torsion spring may be used in like manner to the design shown in FIG. 1). The outer end of line 365 is extendable out of housing 220 of self-retracting lifeline 200, e.g. between optional guide rollers 271 each of which resides upon a guide roller axle 270. Optional divider 272 may be positioned generally in between guide rollers 271 to further enhance the guiding of line 365.

Drum 330 is mounted onto shaft 310. Shaft 310 is connected to housing 220 by a load-bearing connection. In the illustrated design of FIG. 2, terminal ends 315 and 317 of shaft 310 are received into shaft-receiving receptacles 223 and 224 of housing 220 (with end 317 not being directly visible due to the angle of view). In some embodiments, first terminal end 315 of shaft 310 may be nonrotatably mounted within shaft-receiving receptacle 223 of housing piece 221. Likewise, second terminal end 317 of shaft 310 may be nonrotatably mounted within shaft-receiving receptacle 224 of housing piece 222. Such nonrotatable mounting may be achieved by providing a pin (e.g., pin 316) at one or both terminal ends of the shaft and providing a mating slot (e.g., slot 226) proximate a shaft-receiving receptacle of housing 220. Such a pin can reside in such a mating slot so as to substantially prevent shaft 310 from rotating relative to housing 220.

Shaft 310 supports drum 330 so that drum 330 can rotate relative to housing 220. If shaft 310 is nonrotatably connected to housing 220 as described above, drum 330 may be rotatably mounted upon shaft 310. However, in some embodiments shaft 310 may be rotatably connected to housing 220, in which case drum 330 may be nonrotatably mounted upon shaft 310. In either case, the ability of drum 330 and/or shaft 310 to rotate relative to housing 220 is typically desired in order that line 365 may be wound and unwound therefrom. Those of ordinary skill will appreciate that the above are merely particular ways in which a shaft 310 may be load-bearingly seated to (e.g., mounted onto or into) a shaft-seating feature of housing 220 and will understand that many such ways of seating such shafts exist. For example, rather than receptacle 224, a shaft-seating feature of housing 220 might be a protruding member of housing 220 that is received into an axial bore of shaft 310 at the terminal end of shaft 310.

As illustrated in FIGS. 2 and 3, shaft-receiving receptacle 224 may be a bore (e.g., a molded bore) in a projection (e.g., a molded projection) 225 of housing piece 222 (shaft-receiving receptacle 223 of housing piece 221 may likewise be a bore in a projection). In some embodiments, housing 220 (e.g. housing piece 222 or 221) comprises at least one radial rib 233 that is connected to and integrally molded with a molded projection 225 that comprises a shaft-receiving receptacle 224. By rib is meant an elongated member that is connected to and integrally molded with housing 220 (e.g., with housing piece 222) and that protrudes inward into the interior space at least partially defined by housing 220. In some embodiments, a rib may protrude inward in a direction generally perpendicular to the plane of ratchet ring 70, as in FIG. 2. Radial rib 233 may extend generally radially outward to, and be connected to and integrally molded with, a molded projection 231 that comprises a bore 230 configured to receive a protruding member of friction brake 80. Instead of or in addition to extending to a molded projection 231, a radial rib 233 may extend radially outward to, and be connected to and integrally molded with, a primary rib 232 (described later herein). Both types of radial ribs are shown in FIGS. 2 and 3.

Figure 4:
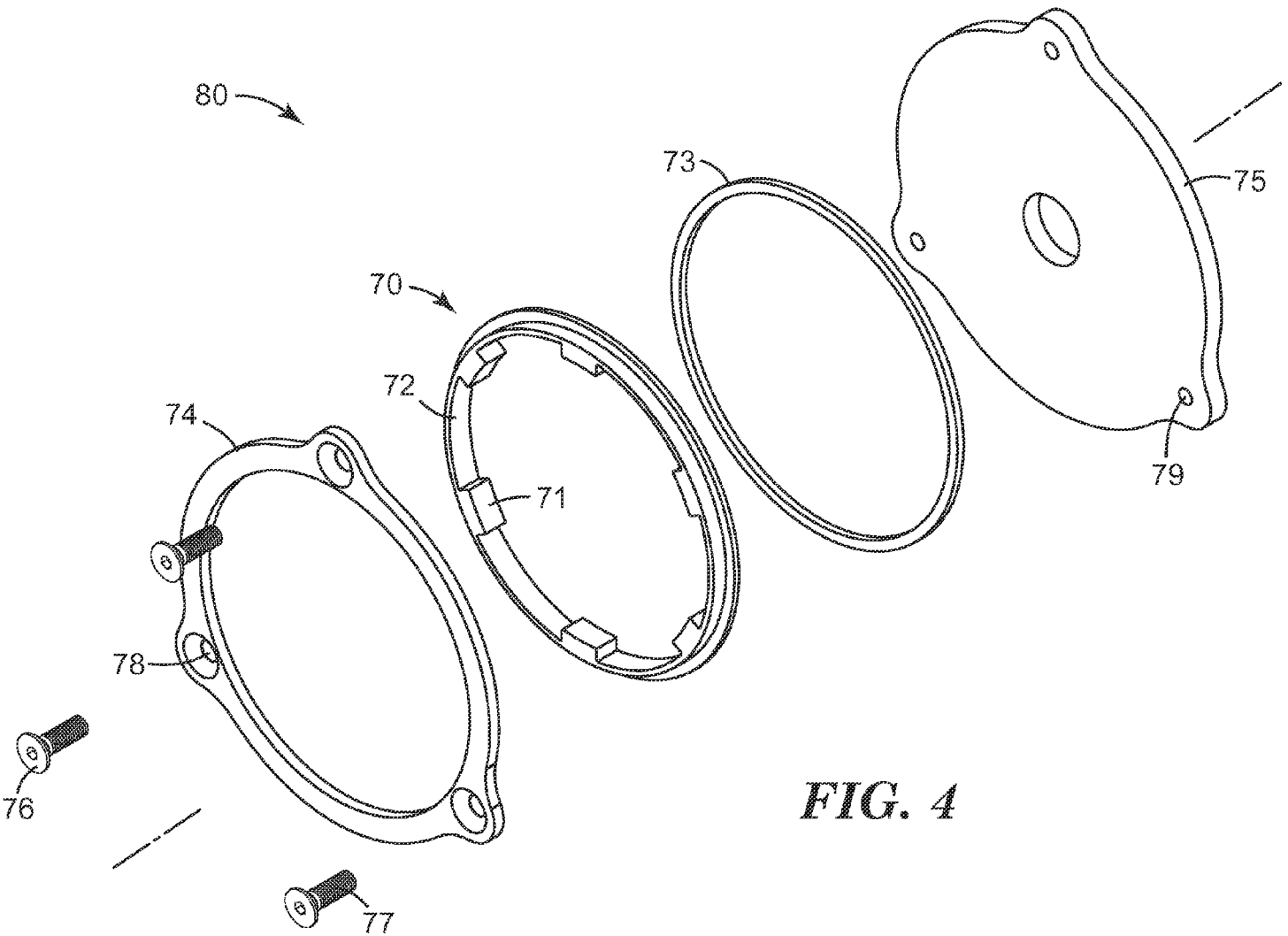
FIG. 4 is an exploded side perspective view of an exemplary friction brake of the safety device of FIG. 2.

In the exemplary embodiment of FIG. 2, friction brake 80 is mated to housing 220. Friction brake 80, as shown in detail in FIG. 4, may comprise at least ratchet ring 70, friction ring 73, pressure plate 74, and backing plate 75. The term ratchet ring is used broadly to denote any structure that can present at least one ratchet tooth 71 in a configuration in which it is capable of being engaged by a pawl as described later herein. Often, ratchet ring 70 will comprise a main body 72 that presents one, two, three, or more ratchet teeth 71 annularly spaced around (i.e., radially outward of) an area swept out by the path of rotation of one or more pawls. Main body 72 may conveniently be generally ring shaped but does not necessarily have to be so; all that is needed is for main body 72 to provide and support the at least one ratchet tooth 71 so that it can be engaged by an engaging end of a pawl. Similarly, friction ring 73 may conveniently be generally circular in shape but this is not necessarily required. Likewise, pressure plate 74 and backing plate 75 may conveniently be generally circular in shape, but do not have to be as long as they provide their function of pressing friction ring 73 and ratchet ring 70 together with the desired pressure. The term ring as used herein thus broadly encompasses any geometric shape that will provide the above-described functions.

Friction ring 73 may be made of any suitable material that will provide the desired friction when a surface of friction ring 73 is pressed against a surface of ratchet ring 70. Such materials may include e.g. cork, rubber, or other natural polymeric materials, synthetic polymeric materials, and the like. Ratchet ring 70, backing plate 75, and pressure plate 74 may be made of any suitable materials, including e.g. metals such as steel, brass, bronze, and the like. In some embodiments, at least one or more of these components (e.g., ratchet ring 70) may be comprised of a molded polymeric material, as long as the component(s) suitably performs the desired function. In at least some embodiments a surface of pressure plate 74 is pressed against a surface of ratchet ring 70. In such cases the friction between pressure plate 74 and ratchet ring 70 may contribute (e.g. in addition to the friction between friction ring 73 and ratchet ring 70) to the slowing or halting of ratchet ring 70, thus in such cases the frictional properties of at least the ratchet ring-contacting surface of pressure plate 74 should be considered when choosing the material(s) making up pressure plate 74. Other components (e.g. one or more washers and the like) may be included in friction brake 80 if desired. In the exemplary illustration of FIG. 4, the heads of bolts 76 are seated against bolt head-seating apertures 78 of pressure plate 74, with threaded shanks 77 of bolts 76 being threadably engaged into threaded bores 79 of backing plate 75 so as to tighten pressure plate 74 and backing plate 75 together with ratchet ring 70 and friction ring 73 sandwiched therebetween, in order to press friction ring 73 and ratchet ring 70 against each other. In some embodiments, rather than a separate backing plate 75 being used, an interior surface of a housing (e.g., of housing piece 222) may be used to press friction ring 73 against ratchet ring 72. Such arrangements will be understood by those of skill in the art to be encompassed within the present use of the term friction brake.

Use of a friction brake (e.g., in place of a ratchet ring that is fixedly and nonrotatably attached to the housing of a safety device incorporating the ratchet ring) can provide that, upon the engaging of a pawl with ratchet ring 70 as discussed in detail later herein, ratchet ring 70 may rotate at least somewhat (e.g., relative to housing 220) before being slowed or stopped by the friction between friction ring 73 and ratchet ring 70, e.g., under pressure from pressure plate 74 and backing plate 75 (as mentioned, friction between a surface of pressure plate 74 and a surface of friction ring 73 may also contribute). The use of a friction brake may thus provide a more gradual stopping process in comparison to that provided by a ratchet ring that is fixedly attached to a housing of a safety device such that the ratchet ring cannot rotate relative to the housing.

In various embodiments, friction brake 80 can be attached to housing 220, or can be a floating brake. In various embodiments, friction brake 80 can be a preassembled and pretorqued brake. The optional use of floating brakes, and/or preassembled and pretorqued friction brakes, is discussed in further detail in copending U.S. patent application Ser. No. 12/821,760, titled PREASSEMBLED AND PRETORQUED FRICTION BRAKE AND METHOD OF MAKING A SAFETY DEVICE CONTAINING SUCH A FRICTION BRAKE, filed evendate herewith and published on 29 Dec. 2011 as US Patent Application Publication No. 2011/0315482, which is herein incorporated by reference.

Friction brake 80 is nonrotatably mated to housing 220 of safety device 200, meaning that backing plate 75 and pressure plate 74 of friction brake 80 cannot rotate relative to housing 220. Ratchet ring 70 may of course be able to rotate at least somewhat relative to backing plate 75, pressure plate 74, and/or housing 220, with such rotation of ratchet ring 70 being limitable or arrestable by friction in the functioning of friction brake 80, as explained earlier herein. In some embodiments, housing 220 and/or friction brake 80 may comprise features that may enhance the preventing of backing plate 75 and/or pressure plate 74 from rotating when friction brake 80 is under load. In specific embodiments, preassembled and pretorqued friction brake 80 may be nonrotatably mated to housing 220 by way of at least one mating feature of friction brake 80 that is mated to at least one complementary mating feature of housing 220 so as to at least assist in preventing at least backing plate 75 of friction brake 80 from rotating when friction brake 80 is under load. Such a mating feature of friction brake 80 can be any suitable feature, e.g. a protruding feature or a recessed feature, a combination thereof, etc., that is e.g. built into, connected to, attached to, etc., backing plate 75 and/or pressure plate 74. In some embodiments, the mating feature of friction brake 80 is a protruding member with the complementary mating feature of housing 220 being a receptacle designed to accommodate the protruding member of friction brake 80. Such a protruding member mating feature of friction brake 80 may be conveniently provided by a portion of shank 77 of bolt 76 that protrudes beyond backing plate 75 so as to be available to reside in a mating receptacle provided in housing 220. (While shanks 77 of bolts 76 are obscured in the view of friction brake 80 in FIG. 2, the exploded view of FIG. 1 illustrates how shanks 77 of bolts 76 may be sufficiently long so as to extend through bores 79 of backing plate 75 so as to protrude beyond backing plate 75).

The receptacle(s) of housing 220 that are designed to accommodate protruding member(s) of friction brake 80, may each be a bore (e.g., a molded bore) 230 in housing 220 (e.g., within a projection, e.g. a molded projection, 231 that protrudes inward from housing 220). A single bore 230 may be used. Or, as shown in FIGS. 2 and 3, multiple bores 230 may be present, arranged so that each bore 230 can receive a protruding member mating feature of friction brake 80. Projection(s) 231 each comprising a bore 230 may be inserted separately into housing 220, but in some embodiments may be integrally molded with housing 220 (e.g., with housing piece 222 or 221).

In some embodiments, housing 220 of device 200 comprises at least one primary rib 232 that is connected to and integrally molded with at least one molded projection 231 of housing 220. As shown in the exemplary illustration of FIG. 2, a primary rib 232 is a rib that extends from a molded projection 231 in a direction that is generally aligned with a direction along which force would be applied to the molded projection 231 by a mating feature of friction brake 80 when friction brake 80 is under load. In various embodiments, a primary rib may be linear or arcuate. In some embodiments, a primary rib may extend from a first molded projection to a second molded projection with which it is also integrally molded. In a further embodiment, housing 220 may comprise a plurality of bores 230 each in a molded projection 231, with each bore 230 configured to receive a protruding member mating feature of friction brake 80, with housing 220 also comprising a plurality of primary ribs 232, each rib 232 extending in a generally semicircular arc between two of the molded projections 231 and connecting to and being integrally molded with the two molded projections, as in the exemplary embodiments illustrated in FIGS. 2 and 3. In some embodiments housing 220 may comprise a central rib 257 that extends from molded projection 256 generally along the vertical axis of device 200, to either connect with a primary rib 232 or to terminate proximate thereto. Central rib 257 may be substantially aligned with one of the aforementioned radial ribs, as in the design of FIG. 3.

Although not visible in second housing piece 221, it should be understood that features such as one or more primary struts, secondary struts, tertiary struts, primary ribs, radial ribs, central ribs, projecting support features at the location at which a load is transmitted into the housing, projections with a bore therein to receive a protruding member of a friction brake or to receive a terminal end of a shaft, and the like, may also be provided in housing piece 222 in like manner to their provision in housing piece 221. However, it should also be understood that such features may be optional in a particular safety device.

In some embodiments, a centrifugal braking mechanism used in device 100 or 200 may be of the general type shown in FIG. 2, e.g. comprising pawls 350 that are pivotably mounted on flange 336 of drum 330 (those of ordinary skill will recognize that in a centrifugally-operated braking mechanism utilizing a drum comprising one or more pawls, the pawls may be mounted directly on drum 330 as in FIG. 2 or may be mounted on a shaft on which the drum is mounted). Each pawl 350 comprises an engaging end 351 capable of engaging with a tooth 71 of ratchet ring 70 (which may be fixedly attached to housing 220, or may be provided as part of a friction brake as in the design of FIG. 2). Pawls 350 are biased by springs 340 so that engaging ends 351 are biased radially inward relative to the axis of rotation of drum 330.

In some embodiments, the centrifugal braking mechanism may be of the type shown in FIG. 1, comprising a shaft 10 on which a drum 50 is coaxially mounted and having an axis of rotation generally aligned with the long axis of the shaft, along with a pawl 30 that is coaxially mounted on the shaft and that is movable radially inwardly and outwardly from the shaft and that comprises an engaging end configured to engage a ratchet ring, and a biasing mechanism (spring 40) that biases the engaging end of the pawl radially inwards toward the shaft. These components may be configured such that the axis of rotation of the shaft passes through the body of the pawl and such that the pawl comprises a center of mass that is radially offset from the axis of rotation of the shaft. The optional use of such a centrifugally operated apparatus is discussed in further detail in copending U.S. patent application Ser. No. 12/821,421, titled CENTRIFUGALLY-OPERATED APPARATUS, filed evendate herewith and published on 29 Dec. 2011 as US Patent Application Publication No. 2011/0315481, which is herein incorporated by reference.

It will be apparent to those skilled in the art that the specific exemplary structures, features, details, configurations, etc., that are disclosed herein can be modified and/or combined in numerous embodiments. All such variations and combinations are contemplated by the inventor as being within the bounds of the conceived invention. Thus, the scope of the present invention should not be limited to the specific illustrative structures described herein, but rather extends at least to the structures described by the language of the claims, and the equivalents of those structures. To the extent that there is a conflict or discrepancy between this specification and the disclosure in any document incorporated by reference herein, this specification will control.

What is claimed is:

1. A fall-protection device comprising:

a load-bearing housing comprised of a composite polymeric material;

a rotatable drum mounted on a shaft that is load-bearingly connected to the housing;

a centrifugal braking mechanism configured to limit or arrest a rotation of the drum upon rotation of the drum above a predetermined speed;

a length of line with a first end attached to at least one of the rotatable drum or the shaft;

and, a load-bearing anchorage plate connected to the load-bearing housing by one or two load-bearing connectors, wherein, when the device is under a load, a primary load-bearing path from the load-bearing anchorage plate, to the shaft, is through the load-bearing housing; and wherein the fall-protection device has a first anchorage end and a second opposite end that is generally opposite the first anchorage end, the shaft is positioned between the first anchorage end and the second opposite end of the device, the second end of the fall-protection device comprises an opening through which the length of line is extendable, and wherein the load-bearing anchorage plate comprises a first end and a second opposite end, the first end of the anchorage plate is positioned proximal to the first anchorage end of the fall-protection device and the second opposite end of the anchorage plate is positioned between the first anchorage end of the fall-protection device and the shaft; and the load-bearing housing is comprised of first and second complementary housing pieces with the anchorage plate sandwiched therebetween, the complementary housing pieces are mated and fastened together, at least in part by way of a fastener that is one of said one or two load-bearing connectors used to connect the anchorage plate to the housing, wherein the fastener is seated on a fastener-seating feature of the first complementary housing piece and a fastener-seating feature of the second complementary housing piece, and wherein each complementary housing piece respectively comprises at least two primary struts each of which is connected to and integrally molded with the fastener seating feature of the respective complementary housing piece, wherein the at least two primary struts of the first complementary housing piece comprise a first primary strut and a second primary strut, the first primary strut extends from the fastener-seating feature of the first complementary housing piece to a first lateral wall of the first complementary housing piece, the second primary strut extends from the fastener-seating feature of the first complementary housing piece to a second lateral wall of the first complementary housing piece, with each primary strut of the first complementary housing being connected to and integrally molded with the respective lateral wall that each primary strut of the first complement housing extends to.

2. The device of claim 1 wherein the anchorage plate is made of metal.

3. The device of claim 1 wherein the fastener comprises a member that passes through a fastener-receiving opening in the anchorage plate.

4. The device of claim 3 wherein the member comprises a metal bolt or metal pin.

5. The device of claim 1 wherein the anchorage plate has first and second major surfaces that are substantially covered by the first and second complementary housing pieces and wherein the anchorage plate comprises at least one anchorage opening that is aligned with an anchorage opening in the first complementary housing piece and with an anchorage opening in the second complementary housing piece, with the aligned anchorage openings collectively providing a location for attachment of an anchoring member to the device.

6. The device of claim 1 wherein each complementary housing piece respectively further comprises at least two secondary struts each of which extends in a direction generally parallel to a primary strut of said primary struts and which connects to and is integrally molded with a lateral wall of the first or second complementary housing pieces.

7. The device of claim 6 wherein each complementary housing piece respectively further comprises at least two tertiary struts each of which respectively extends between one of said primary struts and one of said secondary struts and is connected with and integrally molded with said one of said primary struts and said one of said secondary struts.

8. The device of claim 1 wherein the shaft comprises first and second terminal ends that are each seated in a shaft-receiving receptacle comprising a bore in a molded projection that extends inward from the housing, and wherein the housing further comprises at least one radial rib that is connected to and integrally molded with one of the molded projections that comprises one of the shaft-receiving receptacles.

9. The device of claim 1 wherein the length of line is extendable from the device upon rotation of the drum in a first direction and is retractable into the device upon rotation of the drum in a second direction that is opposite from the first direction and wherein the device comprises a torsion spring that imparts a biasing force that serves to rotate the drum in a direction that serves to retract the length of line into the device and wind the length of line onto the drum.

10. The device of claim 1 wherein the centrifugal braking mechanism comprises:

a ratchet ring that generally annularly surrounds at least one pawl that has an engaging end configured to engage the ratchet ring, and, a biasing mechanism that urges the engaging end of the pawl radially inwards toward a first radial position in which the engaging end of the pawl does not engage the ratchet ring, wherein rotating the drum above a predetermined speed causes the pawl to be centrifugally urged radially outward to a second radial position in which the engaging end of the pawl engages the ratchet ring.

11. The device of claim 10 wherein the ratchet ring is part of a friction brake that comprises at least a pressure plate and a friction ring, the friction brake is nonrotatably mated to the housing.

12. The device of claim 10 wherein the ratchet ring is part of a preassembled and pretorqued friction brake that comprises at least a pressure plate, the ratchet ring, a friction ring, and a backing plate.

13. The device of claim 11 wherein the friction brake comprises a plurality of protruding members and wherein the housing comprises a plurality of molded projections and a plurality of bores each in a molded projection of the plurality of molded projections, with each bore configured to receive a protruding member of the friction brake, and wherein the housing comprises a plurality of primary ribs, each primary rib extending in a generally semicircular arc between two of the molded projections that each comprise a bore configured to receive a protruding member of the friction brake, and each primary rib being integrally molded with the two molded projections between which that primary rib extends.

14. The device of claim 1 wherein the composite polymeric material comprises a density of less than 2.0 grams per cubic centimeter.

15. The device of claim 14 wherein the composite polymeric material comprises a molded polyphthalamide-containing polyamide.

16. The device of claim 1 wherein the device is a safety device configured to arrest or limit a rate of fall of a user of the device.

17. The device of claim 16 wherein the safety device is a self-retracting lifeline that is configured to bring the user to a full stop and that is configured to bear a static load resulting from a weight of the user and to bear a dynamic load resulting from deceleration of the user to the full stop.

18. The device of claim 17 wherein the load-bearing anchorage plate is connected to the load-bearing housing by the one or two load-bearing connectors which is a single load-bearing connector.

* * * * *